United States Patent [19]

Weiner

[11] Patent Number: 5,068,929

[45] Date of Patent: Dec. 3, 1991

[54] EDGE RETAINER FOR A FLOATING POOL COVER

[76] Inventor: Robert I. Weiner, 305 W. Chesapeake Ave., Towson, Md. 21520

[21] Appl. No.: 659,673

[22] Filed: Feb. 25, 1991

[51] Int. Cl.[5] ..... E04H 4/00; A47H 13/00

[52] U.S. Cl. ..... 4/503; 4/498; 160/368.1

[58] Field of Search ..... 4/503, 498, 506, 505; 126/415, 426, 445; 248/288.3, 288.5; 160/368.1, 369, 383, 395; 403/56, 76, 386, 388; 52/222, 3; 242/68

[56] References Cited

U.S. PATENT DOCUMENTS 3,124,971 3/1964 Peters et al. ..... 403/56

3,793,657 2/1974 Kaas ..... 4/505

4,994,178 2/1991 Brooks ..... 403/76

*Primary Examiner*—Henry J. Recla

*Assistant Examiner*—David J. Walczak

*Attorney, Agent, or Firm*—Peter L. Klempay

[57] ABSTRACT

In order to prevent the edge of a floating pool cover from rolling downwardly into the water, as would occur if a child fell or stepped onto the cover, upwardly open channels, the outer walls of which are notched at spaced intervals, are affixed to the pool walls immediately above the water level and extend along substantially the entire periphery of the pool, and anchors are attached to the edges of the cover at the same intervals as the notches, each anchor projecting laterally from the cover and having a shank terminating in a bulbous end which may be dropped into the channel.

3 Claims, 2 Drawing Sheets

EDGE RETAINER FOR A FLOATING POOL COVER

The present invention pertains to floating covers for swimming pools and, more particularly, to edge retainers for such covers which serve to prevent the edge of the cover from being depressed downwardly into the water, as may occur when a yound child steps or falls onto the cover.

BACKGROUND OF THE INVENTION

A "solar" swimming pool cover consists of a sheet of plastic material having encased air pockets or bubbles throughout the length and width of the cover. Such a cover is placed directly on the surface of the water in the pool to insulate the body of water, prevent evaporative cooling and, by concentrating sunlight into the water, heat the same. The cover is buoyantly supported on the water and the surface tension between the water and the underside of the cover is sufficient to retain the cover in place even during high winds. For this reason and because "solar" covers are not designed as safety covers, they are not provided with edge attachments such as are used with other types of pool covers such as winter covers that are permanent installations meant to support significant weight.

The lack of edge support for a "solar" or bouyantly supported pool cover, however, presents a major safety hazard, particularly to yound children. If a child steps or falls onto the cover edge, this edge rolls downwardly, dropping the child into the water and under the cover. The cover returns to its undisturbed position within seconds thereby rapidly dampening any wave action and obscures the child from view. Also, such covers are sufficiently opaque as to make viewing of the pool bottom difficult and confusing. As a result, even if a searcher looks for the child in the pool within seconds after the child has fallen in, the pool appears undisturbed and the searcher is likely to look elsewhere. Tragic instances of yound children drowning or suffering brain damage under these circumstances have occurred.

It is the primary object of the present invention to provide an edge retainer for a buoyantly supported pool cover which retainer prevents the cover edges from rolling downwardly into the water in the event the cover is loaded near the edge, as by a young child falling thereon.

It is also an object of the present invention to provide such an edge retainer which does not significantly complicate the processes of placing the cover on the pool or removing the same therefrom and, indeed, enhances such placement and removal.

A further object of the present invention is the provision of such an edge retainer which is readily applied to existing pool walls and covers or incorporated in newly manufactured pools and covers without major expense.

A further object of the present invention is the provision of a simple and effective technique for retaining the pool cover in place under heavy wind conditions and for preventing inadvertent folds and ripples in the cover.

SUMMARY OF THE INVENTION

The above and other objects of the invention which will become apparent hereinafter are achieved by the provision of an edge retainer for use with a buoyantly supported swimming pool cover which retainer includes elongated upwardly opening channels adapted for securement to the side walls of the pool along at least substantially the entire perimeter of the pool at or directly above the normal water line of the pool, the vertical wall of the channel that is spaced from the pool wall being provided with upwardly opening notches at spaced intervals therealong; and a plurality of cover anchors, each anchor having a base adapted to be secured to the cover at the edge thereof, a shank extending from the base, and an enlarged end, the maximum dimensions of the end being greater than the width of the notch in the channel wall, the anchors being located along the periphery of the cover at the same intervals as the notches of the channel wall.

For a more complete understanding of the invention and the objects and advantages thereof, reference should be had to the accompanying drawings and the following detailed description wherein a preferred embodiment of the invention is illustrated and described.

DESCRIPTION OF THE PREFERRED EMBODIMENT

Figure 1:
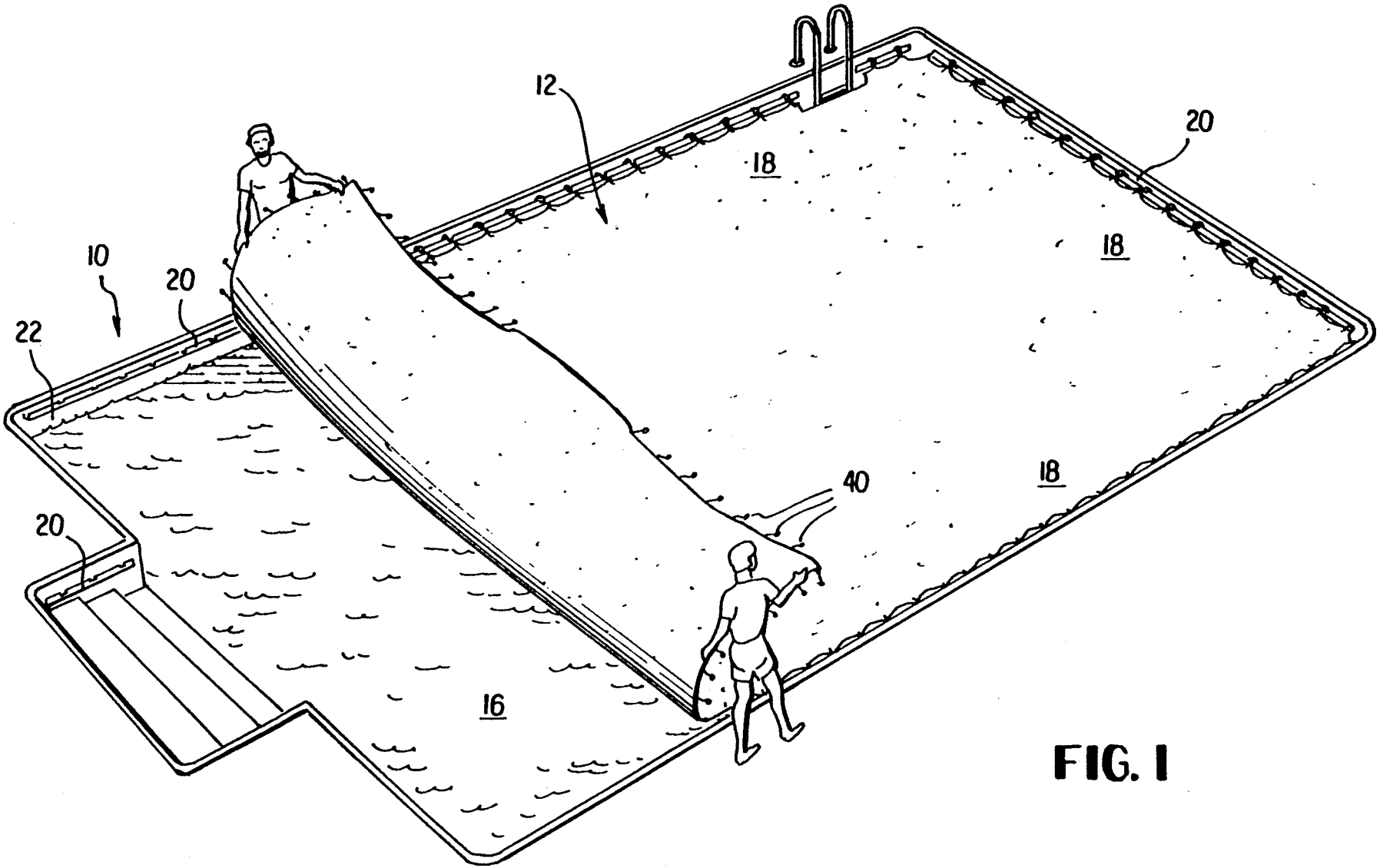
FIG. 1 is a perspective showing of a swimming pool with a buoyantly supported cover and the edge retainer of the present invention.
Figure 2:
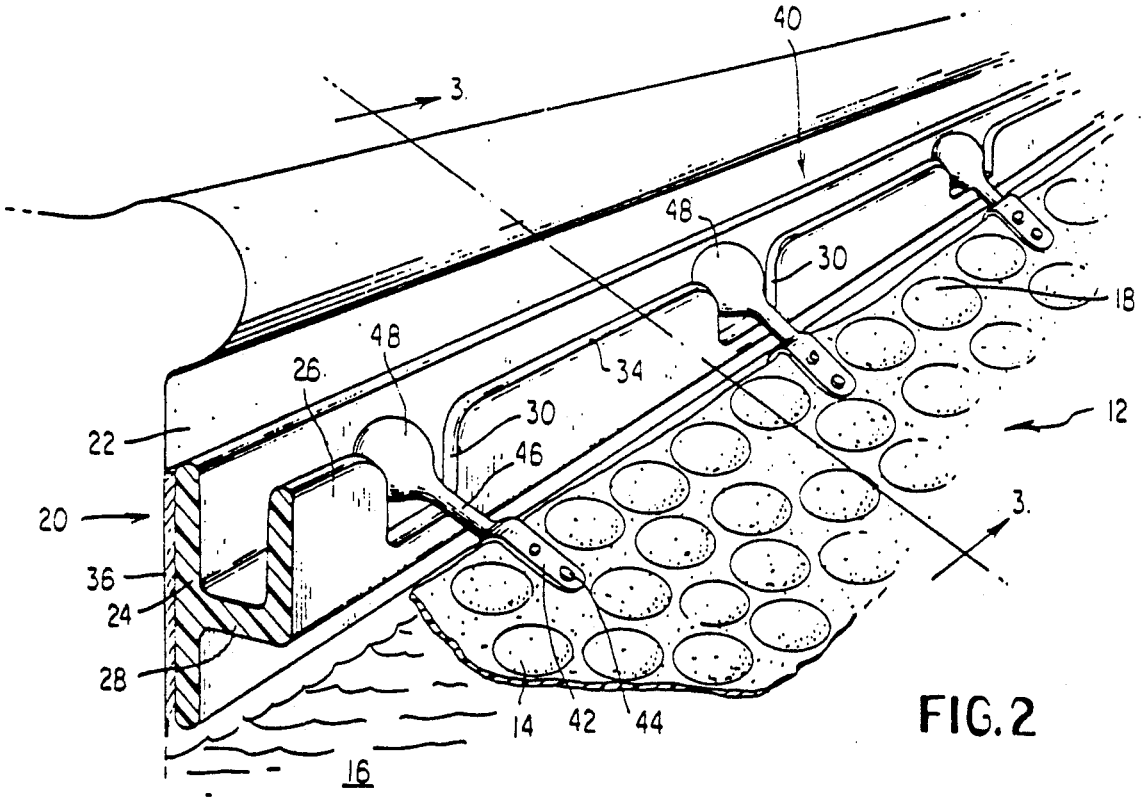
FIG. 2 is a fragementary perspective showing of the edge retainer.
Figure 3:
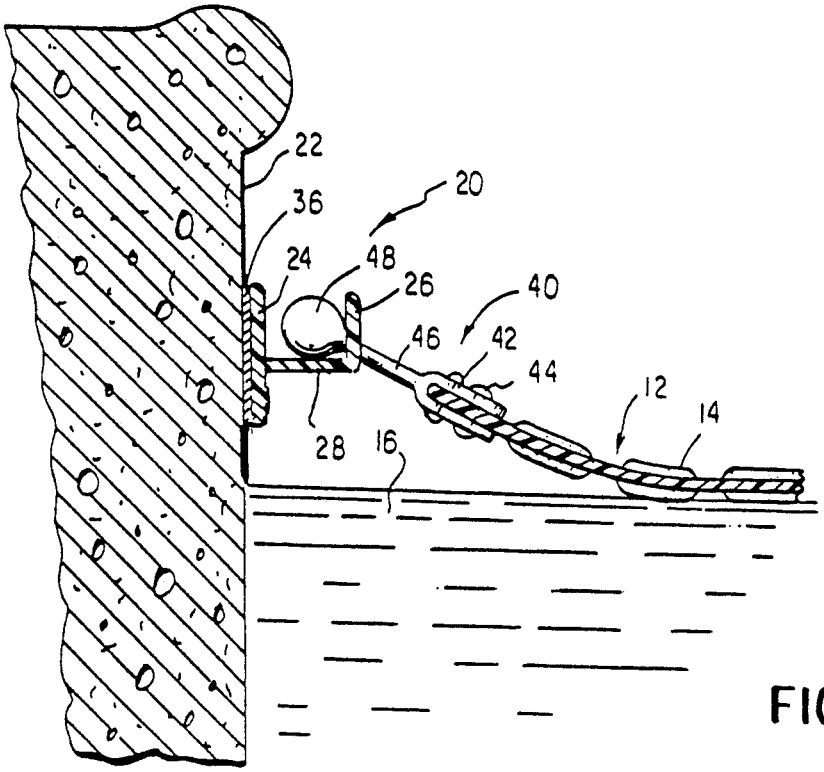
FIG. 3 is a fragmentary cross sectional view taken on the line 3—3 of FIG. 2.

A swimming pool, designated generally by the reference numeral 10, is shown partially covered by a "solar" or buoyant pool cover, designated generally by the numeral 12. Such a cover consists of a plastic sheet with a regular pattern of sealed, air-filled pockets or bubbles 14 throughout the length and width of the cover, the sheet being cut to the general configuration of the pool. The cover is placed directly on the surface of the water 16 in the pool and is buoyantly supported thereon by the air-filled pockets. The surface tension between the water and the lower face of the cover is sufficient to retain the cover in place, even in high wind conditions as long as the cover is not folded or rippled.

Relying solely on the cover buoyancy to support the cover, however, results in a potentially dangerous condition in the zones 18 of the cover adjacent the periphery thereof. If, for example, a young child steps or falls onto the cover, this will usually occur in one of the edge zones 18 and the edge of the cover will roll downwardly, dropping the child into the water. Being buoyant, the cover will return to a floating position immediately and any resultant wave action and air bubbles from the child in the pool are rapidly dampened out so that the cover appears undisturbed within seconds of the incident. This rapid return of the cover to its normal appearance combined with the fact that the cover is sufficiently opaque as to obscure vision into the pool means that, unless an individual actually sees the child enter the pool or observes the pool within less than fifteen to twenty seconds thereafter, there is no indication that the child has fallen in and the individual is likely to search elsewhere for the child.

The present invention eliminates the hazardous condition described above by providing an edge retainer which prevents the edge portions of the floating cover from folding downwardly when any weight is placed thereon. The edge retainer includes a number of elongated channels, designated generally by the numeral 20, which are secured to the side walls 22 of the pool at or immediately above the water line. The channels, which may be plastic extrusions, have a back wall 24, a front wall 26 and a bottom wall 28 connecting the front and back walls to define therewith an upwardly opening channel. The front wall 26 has upwardly opening notches 30 formed at spaced intervals therealong, the edges of these notches preferably being rounded or chamfered. Preferably, the upper edges 32 and 34, respectively, of the back and front walls are smoothly rounded so as to avoid potentially injurious sharp edges. The channel members are provided along substantially the entire perimeter of the pool and are affixed to the pool side walls 22 by any suitable means, such as a combination of stainless steel screws and a water-proof adhesive layer 36. The edge retainer also includes a plurality of anchors, designated generally by the numeral 40, which are attached to the floating cover 12 along the edge thereof at intervals equal to those of the notches 30 in the channel front wall 26. Each anchor has a bifurcated base portion 42 which fits over the edge of the cover and is secured thereto, for example by means of rivets 44, such as plastic pop rivets, waterproof adhesives and/or other fasteners, a shank portion 46 extending from the base portion and an enlarged head 48 at the end of the shank portion 46, the head being of such dimensions as to be insertable into a channel 20 with the shank portion being guided into a notch 30 by the rounded edges thereof to extend through the notch with the head retained against lateral movement through the notch by the sides thereof. As is shown in the drawings, a bulbous configuration of the head is preferred, though other head configurations may be used.

When the cover 12 is placed on the pool, the heads 48 of the anchors 40 are dropped into the channels 20 with the shank portions 46 extending through the notches 30. As the heads are larger than the notches, the anchors secure the edge zones 18 of the cover from downward movement in the event weight is placed thereon, as would occur if a child steps or falls onto the cover. It should be recognized that the edge retainer system of the present invention is intended to provide a safety feature with respect to young children, as they are at the greatest risk of injury or drowning, rather than adults whose greater weight may result in tearing of the cover itself.

To remove the cover from the pool, it is only necessary to lift the same upwardly, no manipulation of the anchors being required. Because of the position and design of the anchors and the channels, the cover is easily put back on the pool and the anchors will self-index and align themselves on the channel cut outs with little extra effort above that needed with ordinary solar covers.

In addition to the safety aspects of the pool cover edge retainer system of the present invention, the system also serves to assure that the cover is properly placed on the water surface, without folds or wrinkles that might detract from its appearance or allow the cover to be blown off the pool in windy conditions.

While a preferred embodiment of the invention has been illustrated and described in detail herein, it will be apparent that changes and additions may be made therein and thereto without departing from the spirit of the invention. Reference should, accordingly, be had to the appended claims in determining the true scope of the invention.

I claim:

1. A swimming pool floating cover edge retainer comprising:

upwardly open channels adapted to be mounted on the side walls of a pool, to extend along substantially the entire perimeter of the pool directly above the pool's normal water level, each channel having an outer wall provided with notches at spaced intervals therealong;

means for affixing said channels to the side walls of the pool;

a plurality of anchors, each anchor having a base, a shank extending from said base and a bulbous end at the free end of said shank, the maximum diameter of said bulbous end being greater than the width of said channel outer wall notch; and means for securing each said anchor to the edge of a floating cover with said shank and said bulbous end projecting laterally therefrom, said anchors adapted to be located on the cover at the same intervals as said notches; whereby the floating cover is retained over the water level in the pool by inserting said anchors through the respective corresponding notches in said channel.

2. A swimming pool floating cover edge retainer comprising:

upwardly open channels adapted to be affixed to the side walls of a pool along substantially the entire perimeter of the pool directed above the pool's normal water level, each of said channels including an outer wall provided with notches extending downwardly from the upper edge thereof at spaced intervals therealong;

means for affixing said channels to the side walls of the pool;

a plurality of anchors removably inserted in said notches, each anchor having a base, a shank extending from said base and an enlarged head at the free end of said shank, the head being of such size as to be receivable within said channel with said shank extending through a notch of said outer wall and retained against movement through said notch; and means for securing said base of said anchor to a floating cover at the edge thereof, said anchors adapted to be located on said cover at the same intervals as said notches.

3. The swimming pool cover edge retainer of claim 2 wherein said head of said anchor has a bulbous configuration.

* * * * *